US009415616B2

(12) United States Patent
Tsuyama

(10) Patent No.: US 9,415,616 B2
(45) Date of Patent: Aug. 16, 2016

(54) RECORDING APPARATUS

(71) Applicant: SEIKO EPSON CORPORATION, Tokyo (JP)

(72) Inventor: Kazuhiko Tsuyama, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/662,935

(22) Filed: Mar. 19, 2015

(65) Prior Publication Data

US 2015/0273905 A1 Oct. 1, 2015

(30) Foreign Application Priority Data

Mar. 25, 2014 (JP) ..... 2014-062090

(51) Int. Cl.

| | |
|---|---|
| ***B41J 29/02*** | (2006.01) |
| ***B41J 13/10*** | (2006.01) |
| ***B41J 29/13*** | (2006.01) |
| *B41J 23/02* | (2006.01) |

(52) U.S. Cl.

CPC ..... *B41J 29/02* (2013.01); *B41J 13/103* (2013.01); *B41J 29/13* (2013.01); *B41J 23/025* (2013.01)

(58) Field of Classification Search

CPC .... B41J 2029/3932; B41J 23/00; B41J 23/04; B41J 29/13; B41J 29/02

USPC ..... 347/108, 104

See application file for complete search history.

(56) References Cited

U.S. PATENT DOCUMENTS

| | | | | |
|---|---|---|---|---|
| 6,618,068 | B2 | 9/2003 | Ishikawa | |
| 6,623,191 | B2 * | 9/2003 | Huggins | B41J 3/36 235/462.43 |
| 6,907,206 | B2 * | 6/2005 | Hattori | G03G 15/80 399/107 |
| 6,969,168 | B2 | 11/2005 | Mo et al. | |
| 7,350,914 | B2 | 4/2008 | Tanaami et al. | |
| 8,113,645 | B2 * | 2/2012 | Koyanagi | B65H 1/00 271/171 |
| 8,439,497 | B2 * | 5/2013 | King | B41J 2/04541 271/207 |
| 2011/0074872 | A1 * | 3/2011 | Ozaki | B41J 2/16523 347/30 |

FOREIGN PATENT DOCUMENTS

| | | |
|---|---|---|
| JP | 3600173 B | 9/2004 |
| JP | 4387651 B | 10/2009 |

* cited by examiner

*Primary Examiner* — Henok Legesse
(74) *Attorney, Agent, or Firm* — Workman Nydegger

(57) ABSTRACT

A recording apparatus includes a medium support unit which supports a medium in an inclined state, a medium feeding unit which sends out the medium which is supported by the medium support unit, a substrate which configures a control unit of the apparatus, and a battery accommodation unit which accommodates a battery which is a power source of the medium feeding unit and the control unit, in which the battery accommodation unit and the substrate are arranged on the lower side of the medium support unit, and the battery accommodation unit is arranged at a location which is separated from a place facing the substrate. At least a part of an arranging region of the battery accommodation unit, and at least a part of an arranging region of the substrate are in the same range in the height direction.

14 Claims, 14 Drawing Sheets

RECORDING APPARATUS

BACKGROUND

1. Technical Field

The present invention relates to a recording apparatus which is represented by a fax machine, a printer, or the like.

2. Related Art

In a recording apparatus which is represented by a fax machine, a printer, or the like, an apparatus which includes a battery, is small and light in weight, and with portability has appeared on the market. Printers which are disclosed in Japanese Patent No. 3,600,173, and Japanese Patent No. 4,387,651 are examples thereof.

There also is a case in which a battery is built inside an apparatus main body, in addition to a configuration in which the battery is detachably provided in the apparatus main body. Meanwhile, since miniaturization of an apparatus is made in a mobile-type printer in which portability is taken into consideration, there is not much space in a housing. In addition, when taking portability into consideration, further miniaturizing is necessary in the market. For this reason, it is necessary to execute miniaturization using an optimal layout while considering a layout of a control substrate, and layout of electronic components, a motor, or the like. In addition, it is necessary to take into consideration a case in which a battery is not capable of exhibiting a desired performance due to being easily influenced by heat, and being out of a usage environment of the battery due to the heat.

SUMMARY

An advantage of some aspects of the invention is to provide a recording apparatus which can maintain a desirable performance by appropriately arranging a substrate and a battery, and appropriately arranging a motor, in addition to that.

According to a first aspect of the invention, there is provided a recording apparatus which includes a housing; a medium feeding unit which sends out a medium; a substrate which configures a control unit of the apparatus; and a battery accommodation unit which accommodates a battery which is a power source of the medium feeding unit and the control unit in the housing; in which the battery accommodation unit is arranged at a location separated from a place which faces the substrate, and at least a part of an arranging region of the battery accommodation unit, and at least a part of an arranging region of the substrate are in the same range in a height direction.

According to the aspect, since in the battery accommodation unit and the substrate, the battery accommodation unit is arranged at a location separated from a place which faces the substrate, there are no cases in which the battery directly receives heat radiated from the substrate, and it is possible to keep the battery in a good state.

In addition, since at least a part of the arranging region of the battery accommodation unit, and at least a part of the arranging region of the substrate are in the same range in the height direction, it is possible to reduce a dimension of the apparatus in the height direction.

In the recording apparatus, at least a part of the arranging region of the battery accommodation unit, and at least a part of the arranging region of the substrate may be in the same range in a depth direction of the apparatus.

According to the aspect, it is possible to reduce a dimension of the apparatus in the depth direction, since at least a part of the arranging region of the battery accommodation unit, and at least a part of the arranging region of the substrate are in the same range in the depth direction of the apparatus.

In the recording apparatus, at least a part of the battery accommodation unit may be put into a first notch portion which is formed on the substrate.

According to the aspect, it is possible to miniaturize the apparatus since at least a part of the battery accommodation unit is put into the first notch portion which is formed on the substrate.

In the recording apparatus, the battery accommodation unit may be provided at a center portion in a medium width direction which is a direction intersecting a medium feeding direction.

The recording apparatus may further include a medium support unit which supports a medium in an inclined state, and in which the battery accommodation unit may be provided on a rear side in an apparatus depth direction, in a space which is formed on a lower side in a state in which the medium support unit is inclined.

The recording apparatus may further include a plurality of substrates, in which a first substrate which configures the plurality of substrates may be provided in an erect posture on a rear side in the apparatus depth direction, and a second substrate which configures a plurality of the substrates may be formed in a posture intersecting the first substrate.

The recording apparatus may further include a first motor and a second motor which are driven by the battery, in which the first motor and the second motor may be provided on both sides of the battery accommodation unit in the medium width direction which is the direction intersecting the medium feeding direction.

According to the aspect, since the first motor and the second motor which are driven by the battery are provided, and the first motor and the second motor are provided on both sides of the battery accommodation unit in the medium width direction which is the direction intersecting the medium feeding direction, heavy goods in the recording apparatus do not incline to one portion, and portability of the apparatus is improved.

In the recording apparatus, at least one of the first motor and the second motor may be put into a second notch portion which is formed on the substrate.

According to the aspect, since at least one of the first motor and the second motor is put into the second notch portion which is formed on the substrate, it is possible to miniaturize the apparatus.

The recording apparatus may further include a medium returning member which returns a tip end of a medium which is sent out from the medium support unit to the medium support unit side, and an opening which is formed on a frame which forms the medium support unit, and exposes the medium returning member, in which the opening may also function as a heat radiating port from which heat generated from the substrate is emitted.

According to the aspect, since the opening which is formed on the frame which forms the medium support unit, and exposes the medium returning member also functions as the heat radiating port from which heat generated from the substrate is emitted, it is not necessary to separately provide the heat radiating port from which heat generated from the substrate is emitted, and it is possible to suppress increase in cost of the apparatus, and to emit heat generated from the substrate well.

In the recording apparatus, the battery accommodation unit may be formed integrally with the frame which forms the medium support unit.

According to the aspect, since the battery accommodation unit is formed integrally with the frame which forms the medium support unit, it is possible to reduce a cost of the apparatus.

In the recording apparatus, heat generated from the substrate may be emitted from the opening through a heat radiating member which is provided at a location facing the opening with respect to the substrate.

According to the aspect, since heat generated from the substrate may be emitted from the opening through the heat radiating member which is provided at the location facing the opening with respect to the substrate, it is possible to prevent dust, or the like, which enters from the opening from being attached to the substrate, and to maintain a performance of the substrate well.

The recording apparatus may further include a liquid ejecting head which ejects liquid with respect to a medium; a support member which is provided at a location in which it is possible to face the liquid ejecting head, and supports the medium; a first liquid holding unit which holds liquid ejected to a region which is separated from an end portion of the medium, and is guided from a higher part to a lower part of the support member; and a second liquid holding unit which holds liquid ejected as waste liquid from the liquid ejecting head, in which an occupying region of the second substrate may overlap an occupying region of the first liquid holding unit, and an occupying region of the second liquid holding unit in the apparatus height direction.

According to the aspect, since the occupying region of the second substrate overlaps the occupying region of the first liquid holding unit, and the occupying region of the second liquid holding unit in the apparatus height direction, it is possible to miniaturize the apparatus in a configuration including the first liquid holding unit and the second liquid holding unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
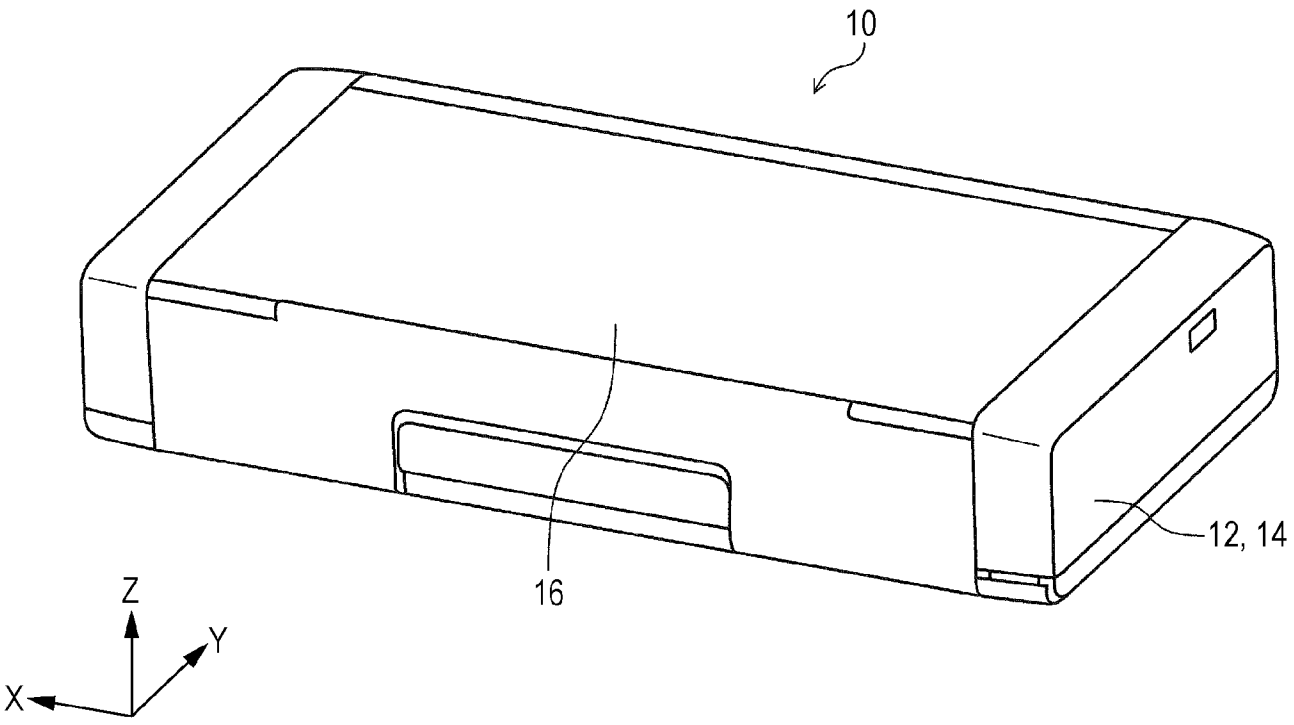
FIG. 1 is a perspective view of the exterior of a printer according to an embodiment of the invention.

Hereinafter, embodiments of the invention will be described based on drawings. In addition, the same configurations in each embodiment will be given the same reference numerals, descriptions will be made only in the first embodiment, and descriptions of the configuration in an embodiment after the first embodiment will be omitted.

Figure 2:
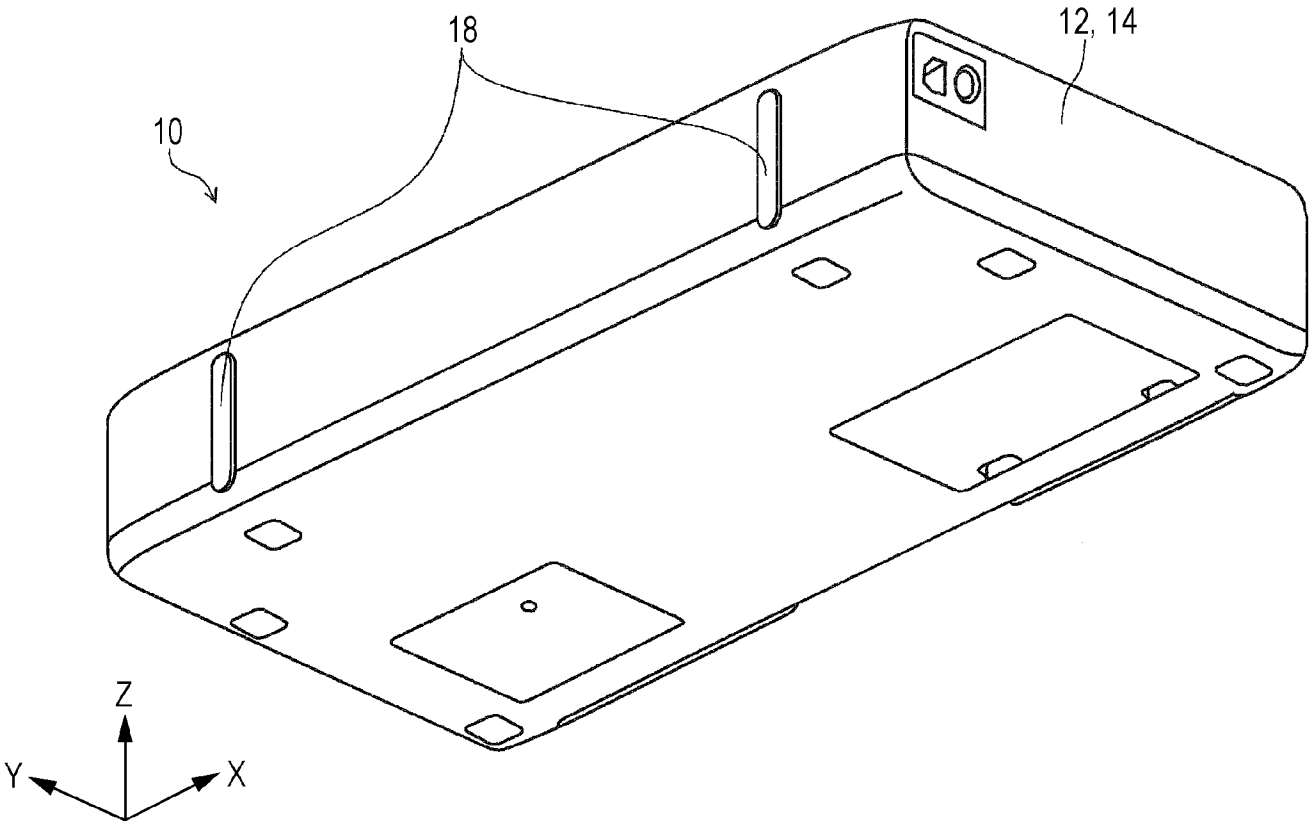
FIG. 2 is a perspective view in which the printer according to the embodiment of the invention is viewed from below.
Figure 3:
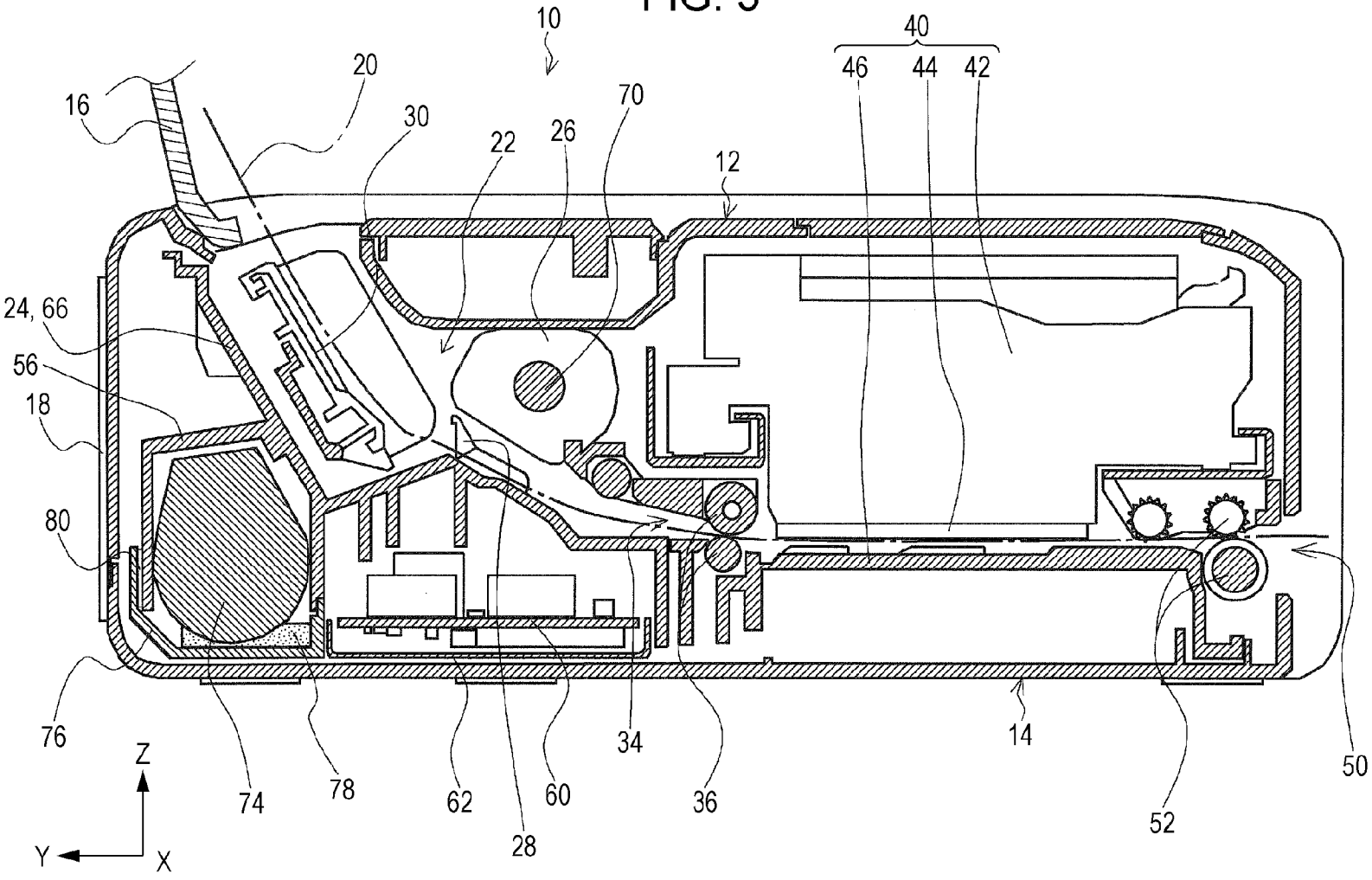
FIG. 3 is a side cross-sectional view which illustrates a medium transport path in the printer according to the embodiment of the invention.
Figure 4:
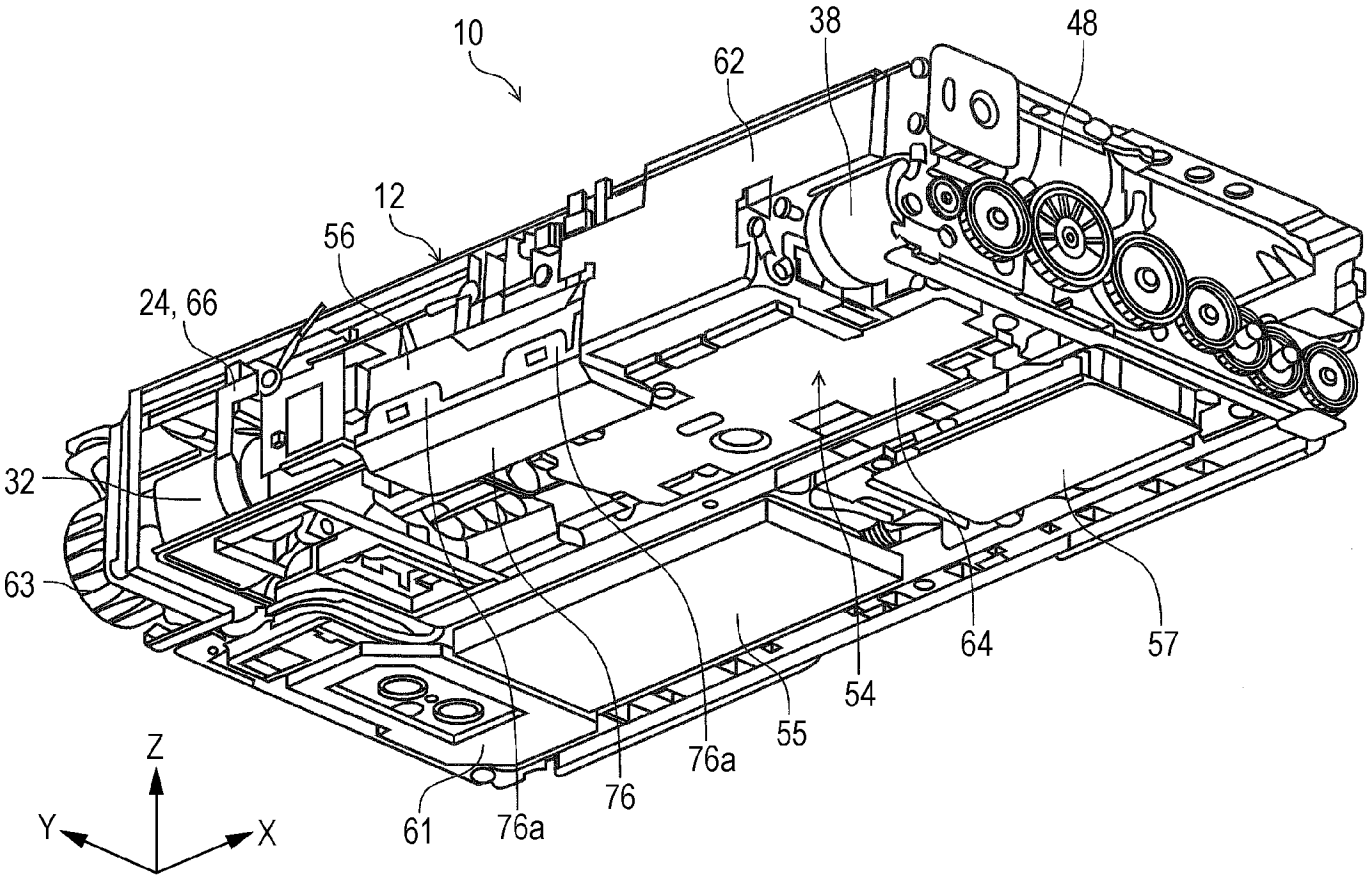
FIG. 4 is a perspective view in which an apparatus main body of the printer is viewed from below.
Figure 5:
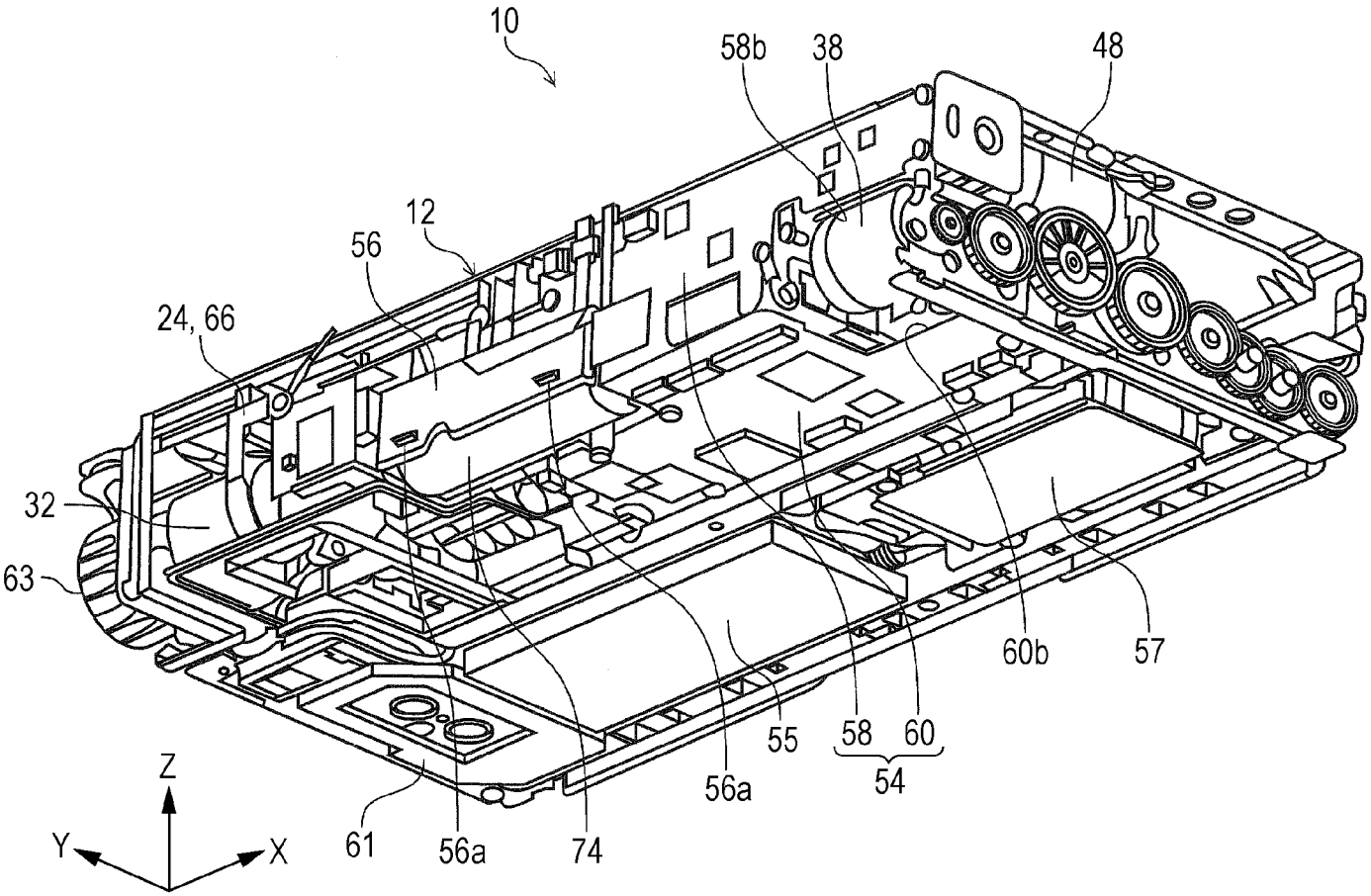
FIG. 5 is a perspective view which illustrates a state in which a shield plate of a substrate and a battery cover are detached in the apparatus main body which is illustrated in FIG. 4.

FIG. 1 is a perspective view of the exterior of a printer (hereinafter, referred to as printer 10) according to an embodiment of the invention, FIG. 2 is a perspective view in which the printer 10 is viewed from below, FIG. 3 is a side cross-sectional view which illustrates a medium transport path in the printer 10, FIG. 4 is a perspective view in which an apparatus main body of the printer 10 is viewed from below, and FIG. 5 is a perspective view which illustrates a state in which a shield plate of a substrate and a battery cover are detached in the apparatus main body which is illustrated in FIG. 4.

Figure 6:
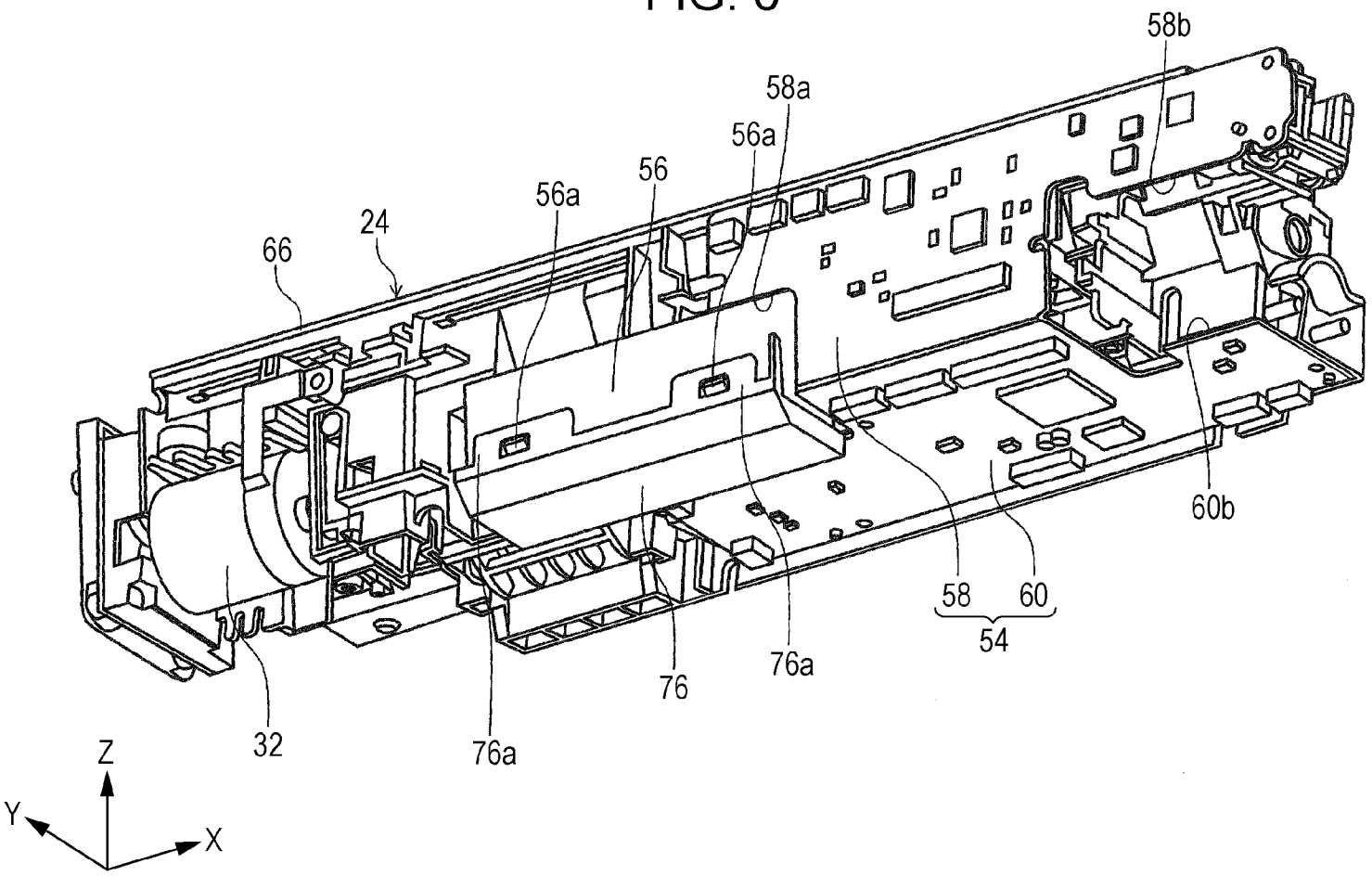
FIG. 6 is a perspective view which illustrates a positional relationship between a battery accommodation unit and a first substrate, and a second substrate in a medium support unit.
Figure 7:
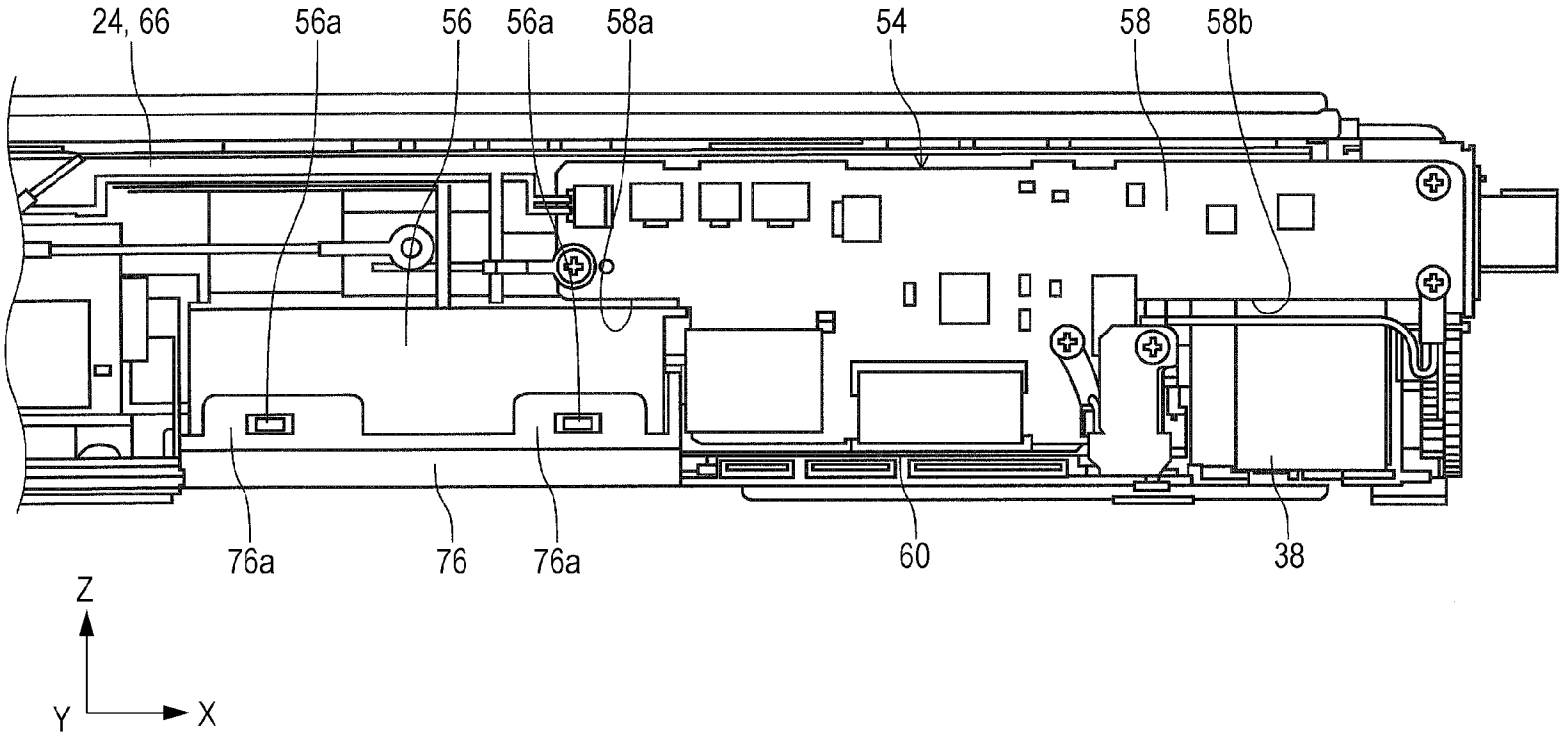
FIG. 7 is a plan view which illustrates a positional relationship between the first substrate and a battery on the rear surface of the apparatus main body.
Figure 8:
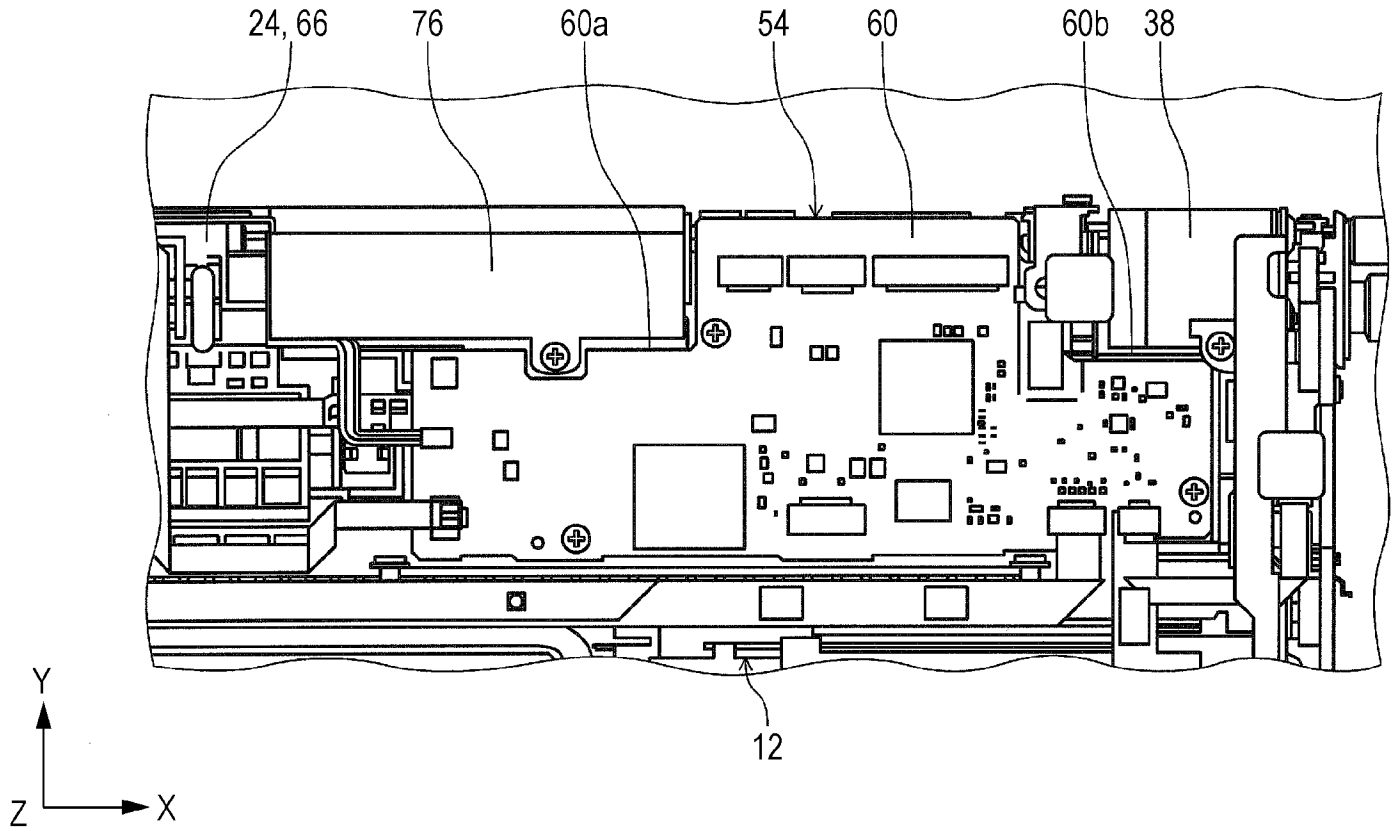
FIG. 8 is a plan view which illustrates a positional relationship between the second substrate and the battery on the lower face of the apparatus main body.
Figure 9:
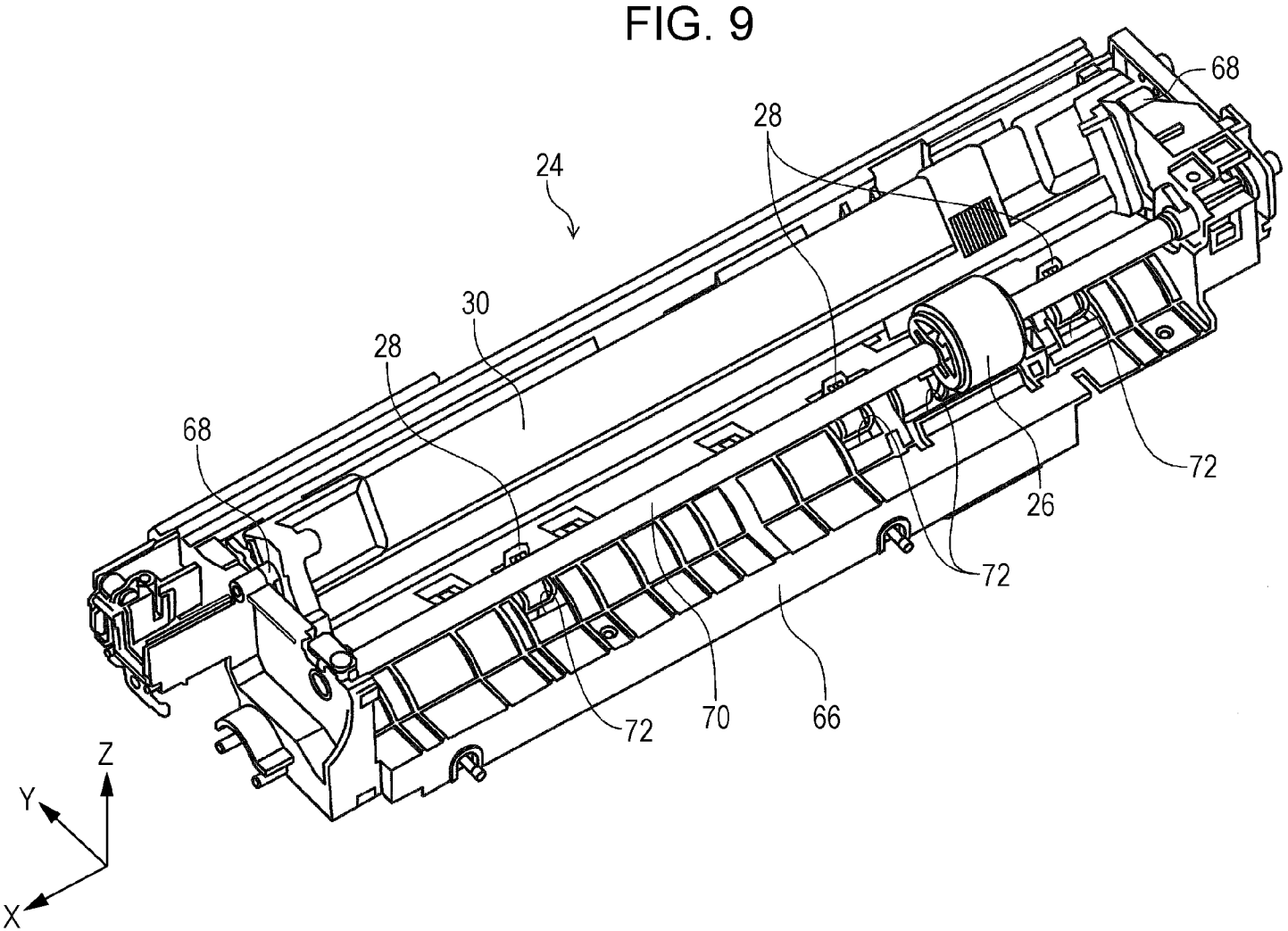
FIG. 9 is a perspective view of the exterior of a medium support member which is viewed from above.
Figure 10:
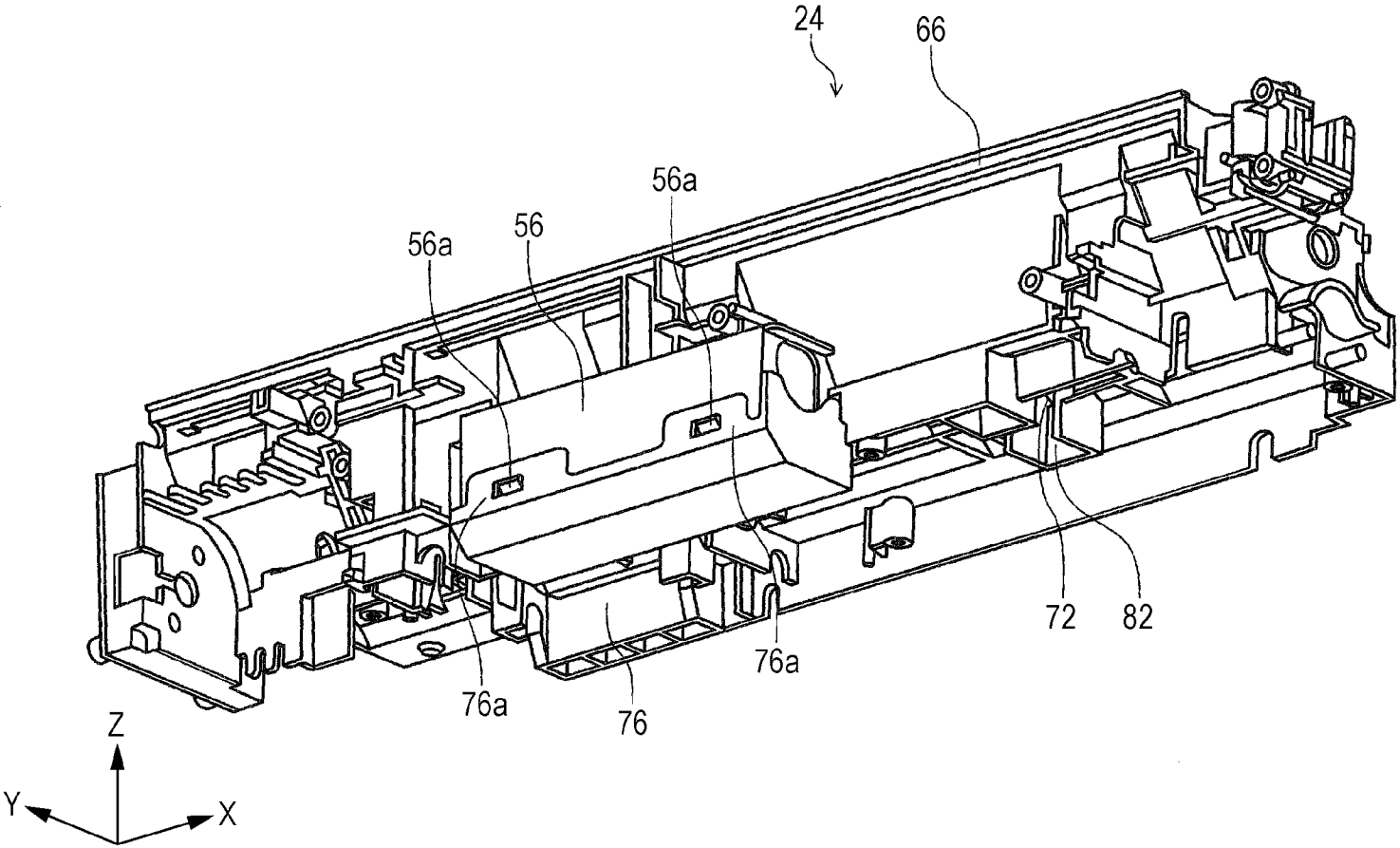
FIG. 10 is a perspective view of the medium support member which illustrates a state in which the battery is mounted on the medium support member.

FIG. 6 is a perspective view which illustrates a positional relationship between a battery accommodation unit and a first substrate and a second substrate in a medium support unit, FIG. 7 is a plan view which illustrates a positional relationship between the first substrate and a battery on the rear surface of the apparatus main body, FIG. 8 is a plan view which illustrates a positional relationship between the second substrate and the battery on the lower face of the apparatus main body, FIG. 9 is a perspective view of the exterior of a medium support member which is viewed from above, and FIG. 10 is a perspective view of the medium support member which illustrates a state in which the battery is mounted on the medium support member.

Figure 11:
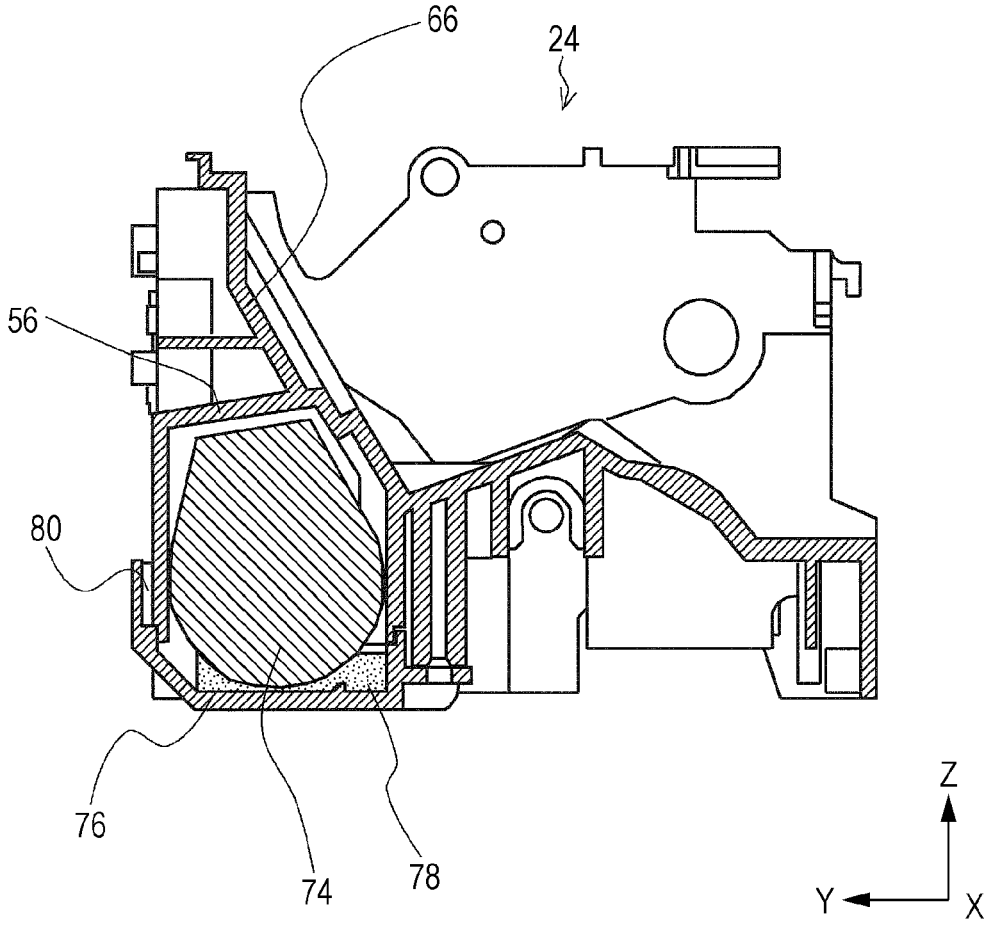
FIG. 11 is a side cross-sectional view of the medium support member which illustrates a state in which the battery is mounted on the medium support member.
Figure 12:
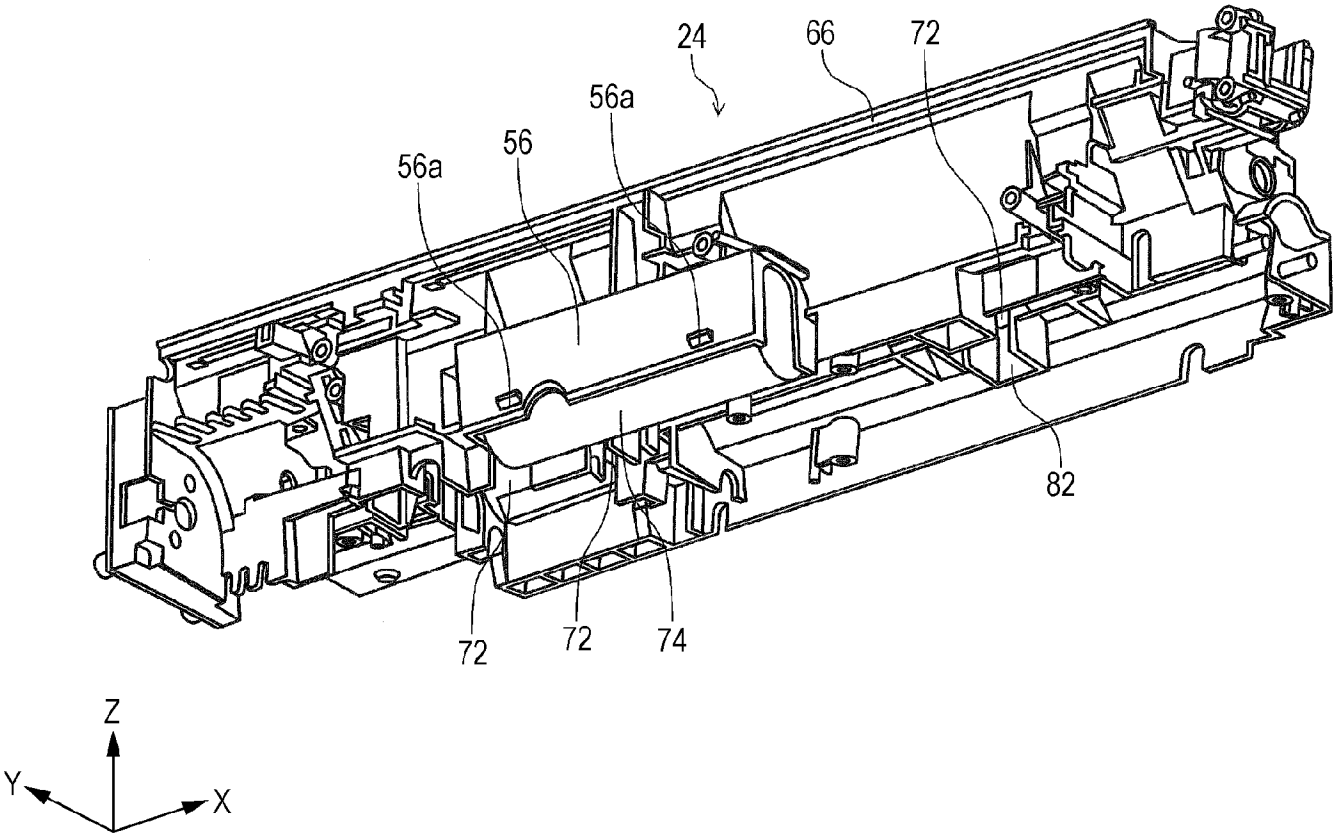
FIG. 12 is a perspective view of the medium support member which illustrates a state in which a battery cover is detached from the medium support member which is illustrated in FIG. 10.
Figure 13A:
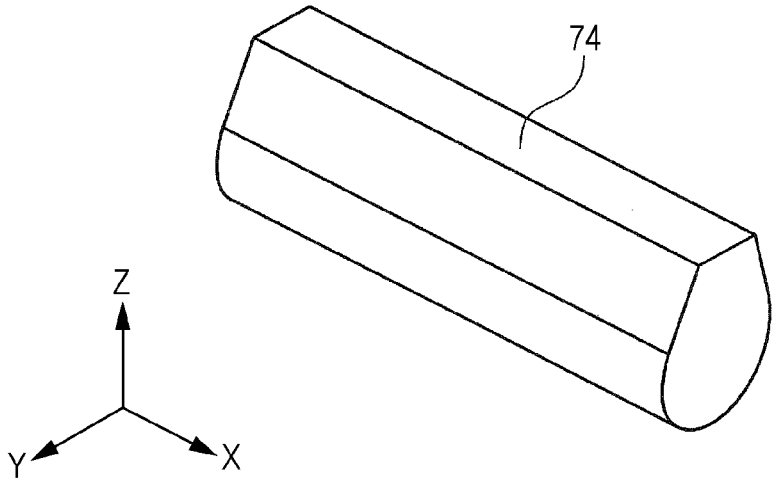
FIG. 13A is a perspective view of the exterior of the battery.
Figure 13B:
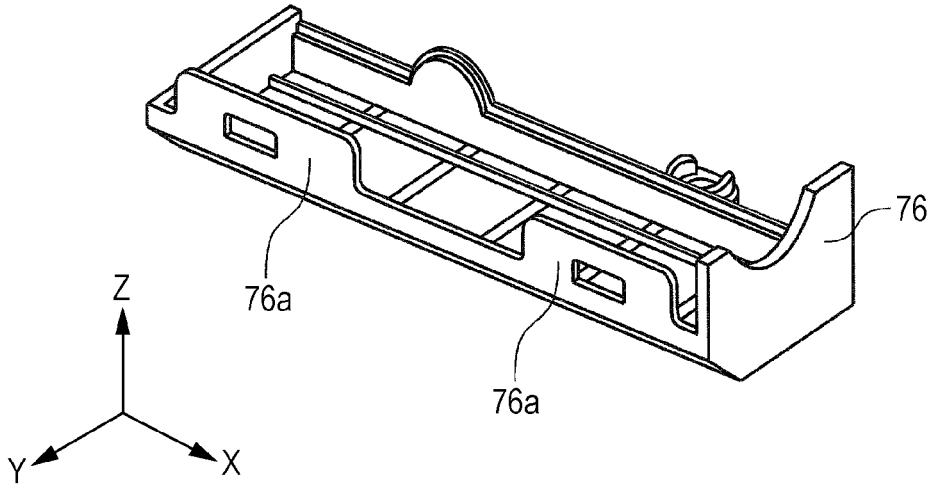
FIG. 13B is a perspective view of the exterior of the battery cover.
Figure 14:
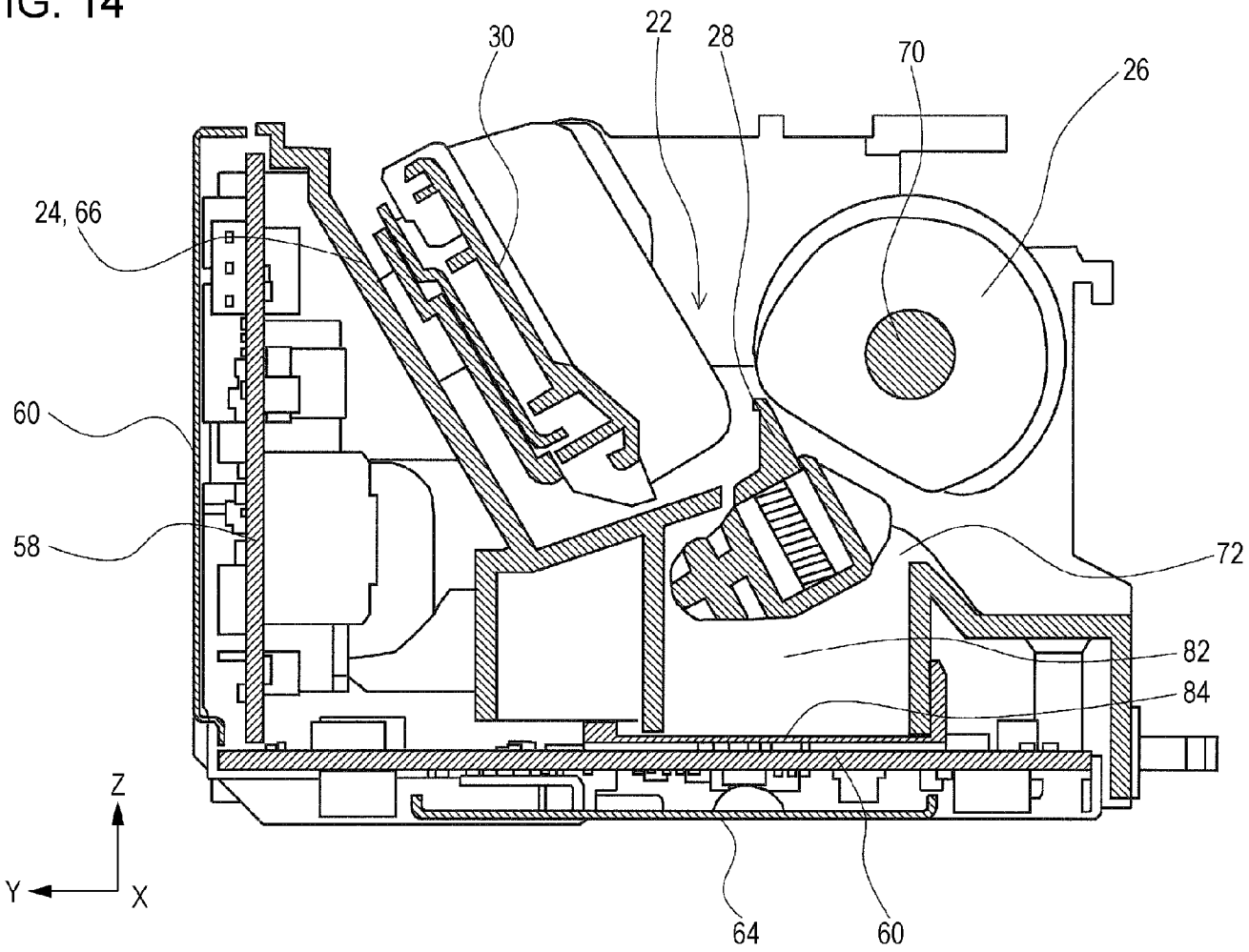
FIG. 14 is a cross-sectional view of a portion at which a medium returning lever is provided in the medium support member.

FIG. 11 is a side cross-sectional view of the medium support member which illustrates a state in which the battery is mounted on the medium support member, FIG. 12 is a perspective view of the medium support member which illustrates a state in which a battery cover is detached from the medium support member which is illustrated in FIG. 10, FIG. 13A is a perspective view of the exterior of the battery, FIG. 13B is a perspective view of the exterior of the battery cover, and FIG. 14 is a cross-sectional view of a portion at which a medium returning lever is provided in the medium support member.

In the XYZ coordinate system illustrated in each drawing, an X direction denotes a scanning direction of a recording head and the apparatus width direction, a Y direction denotes the depth direction and a sheet transport direction of the recording apparatus, and a Z direction denotes the apparatus height direction, and a direction in which an apparatus main body, an extension unit, and a supporting stand which will be described later overlap. In addition, in each drawing, a −Y direction is set to the front face side of the apparatus, and a +Y direction is set to the rear surface side of the apparatus.

Regarding Outline of Printer

The ink jet printer 10 (hereinafter, referred to as printer 10) as an example of the recording apparatus will be described with reference to FIGS. 1 to 3. The printer 10 includes an apparatus main body 12 (refer to FIG. 4), a housing 14 which configures the exterior of the apparatus main body 12, and a cover 16 which is opened or closed with respect to the apparatus main body 12.

The cover 16 is rotatably attached to the apparatus main body 12, and is brought into a closed state as illustrated in FIG. 1, and an open state by being rotated with respect to the apparatus main body 12 as illustrated in FIG. 3. In addition, only a part of the cover 16 is illustrated in FIG. 3 for description. In addition, the cover 16 configures a part of a top face and the front face of the printer 10 in the closed state as illustrated in FIG. 1.

In addition, as illustrated in FIG. 2, a plurality of elastic members 18 are provided on the rear surface of the housing 14 of the printer 10. The elastic member 18 functions as a support unit when placing the rear surface side of the printer 10 on a desk, a table, or the like, as a base portion.

Subsequently, constituent elements on a medium transport path in the printer 10 will be further described in detail with reference to FIG. 3. In FIG. 3, the right side on a paper face (rear surface side of apparatus) is the upstream side on a feeding path, and the left side on the paper face (front face side of apparatus) is the downstream side of the feeding path. In addition, a dot and dash line with a reference numeral 20 in FIG. 3 denotes a transport path of a medium. In addition, the medium in the specification means a sheet such as plain paper, a picture, a postcard, or the like.

A medium supply unit 22 which can supply a medium in a state in which the cover 16 is open with respect to the housing 14 is provided on the upstream side on the feeding path. The medium supply unit 22 includes a medium support unit 24 which supports the medium in an inclined posture, a feeding roller 26 as a "medium feeding unit" which transports the medium which is supported by the medium support unit 24 to the downstream side of the medium transport path, and a medium returning lever 28.

The medium support unit 24 is formed downward toward the −Y direction side in an inclined shape in FIG. 3. In addition, the medium support unit 24 includes a support member 30 (refer to FIG. 9). The support member 30 is configured so as to oscillate in a direction of being close to or separated from the feeding roller 26.

The feeding roller 26 comes into contact with a medium on the top which is mounted on the support member 30 when the support member 30 is displaced in a direction of being close to the feeding roller 26, and feeds the medium on the top to the downstream side of the feeding path. At this time, mediums as the second sheet and thereafter are returned to the support member 30 using the medium returning lever 28, and are prevented from being fed to the downstream side of the feeding path carelessly. In addition, the feeding roller 26 is rotatably driven by a feeding roller driving motor 32 (refer to FIGS. 4 and 5) as a "first motor" which is provided inside the apparatus main body 12.

A transport unit 34 is provided on the downstream side of the medium supply unit 22. A pair of transport rollers 36 is provided in the transport unit 34. The pair of transport rollers 36 is rotatably driven by a driving motor 38 (refer to FIGS. 4 and 5) as a "second motor". The transport unit 34 transports the medium which is fed from the medium supply unit 22 to the downstream side in the transport direction by nipping the medium using the pair of transport rollers 36. A recording unit 40 is provided on the downstream side of the transport unit 34.

The recording unit 40 includes a carriage 42, a recording head 44 which is provided at a base portion of the carriage, and a platen 46 which faces the recording head, and supports a medium. The recording head 44 faces the medium which is supported by the platen 46. The carriage 42 is driven so as to reciprocate in the X axis direction (front-rear direction of paper face) in FIG. 3 using a carriage driving motor 48 (refer to FIGS. 4 and 5) which is provided inside the apparatus main body 12. In addition, the platen 46 defines a distance (gap) between a recording face of a medium and a head face of the recording head 44 by supporting the medium from below.

In the recording unit 40, recording is performed when ink as "liquid" is ejected toward a medium from a plurality of nozzle holes (not illustrated) of the recording head 44, and the ink lands on a recording face (face which faces recording head 44) of the medium, when the medium supported by the platen 46 faces the recording head 44.

A discharging unit 50 is provided on the downstream side of the transport path of the recording unit 40. The discharging unit 50 includes a pair of discharging rollers 52. A medium which is subjected to recording in the recording unit 40 is discharged toward the front side of the apparatus from the front face of the apparatus by being nipped using the pair of discharging rollers 52. In addition, the pair of discharging rollers 52 is rotatably driven by the driving motor 38 (refer to FIGS. 4 and 5) through a plurality of toothed gears.

In addition, in the embodiment, the feeding roller driving motor 32 which rotatably drives the feeding roller 26, the driving motor 38 which rotatably drives the pair of transport rollers 36, and the pair of discharging rollers 52, and the carriage driving motor 48 which moves the carriage 42 in the X axis direction are controlled by a control unit (refer to FIGS. 5 and 6) as a "control unit" which will be described later.

Regarding Embodiments

Regarding Configuration of Apparatus Main Body 12

Subsequently, a configuration of the apparatus main body 12, specifically, the medium support unit 24, the feeding roller driving motor 32, the driving motor 38, the control unit 54, and a battery accommodation unit 56 which will be described later will be described with reference to FIGS. 4 to 8. The medium support unit 24 is arranged at the rear surface side of the apparatus main body 12, that is, at an end portion on the +Y direction side.

The battery accommodation unit 56 is provided on the lower side in the apparatus height direction, that is, on the −Z axis direction side, in the medium support unit 24 when referring to FIG. 6. In addition, the battery accommodation unit 56 is provided at a center portion in the X axis direction which is the width direction of the medium support unit 24. In addition, the battery accommodation unit 56 is provided at an end portion on the +Y direction side in the Y axis direction which is the depth direction of the apparatus in the medium support unit 24.

Here, when referring to FIGS. 4 and 5, the feeding roller driving motor 32 and the driving motor 38 are provided on the rear surface side of the apparatus main body 12, that is, at an end portion of the medium support unit 24 on the +Y axis direction side. According to the embodiment, the feeding roller driving motor 32 is provided at an end portion of the apparatus main body 12 (medium support unit 24) on the −X axis direction side, and the driving motor 38 is provided at an end portion of the apparatus main body 12 (medium support unit 24) on the +X axis direction side. In addition, in FIG. 6, the driving motor 38 at an end portion on the +X axis direction side of the medium support unit 24 is not illustrated.

That is, the battery accommodation unit 56 is provided between the feeding roller driving motor 32 and the driving motor 38 in the X axis direction in the medium support unit 24 (refer to FIGS. 4 to 6).

That is, according to the embodiment, the feeding roller driving motor 32 and the driving motor 38 are respectively provided on both sides of the battery accommodation unit 56 in the X axis direction which is the medium width direction intersecting the Y axis direction which is the medium feeding direction in the apparatus main body 12. Accordingly, heavy goods in the printer 10 do not incline to one portion, and portability of the printer 10 is improved.

In addition, when referring to FIGS. 4 and 5, an ink absorbing body 55 as a "first liquid holding unit", and a waste ink cartridge 57 as a "second liquid holding unit" are provided on the front side of the apparatus at the base portion of the apparatus main body 12. The ink absorbing body 55, and the waste ink cartridge 57 are provided at the lower part of the platen 46, respectively. In addition, the ink absorbing body 55, and the waste ink cartridge 57 are arranged in parallel with respect to the transport direction of the medium at the lower part of the platen 46.

When performing borderless recording on a medium in the recording unit 40, the ink absorbing body 55 is configured so as to hold ink which is ejected to a region separated from an end portion of the medium, and is guided from the higher part to the lower part of the platen 46. Specifically, the ink absorbing body 55 is configured of a sponge material.

In addition, in the apparatus main body 12, a cap unit 61 (refer to FIGS. 4 and 5) is provided at an end portion on the −X axis direction side in a moving region of the carriage 42. The cap unit 61 is connected to a pump 63. The cap unit 61 engages with the recording head 44 when the recording head 44 is at a position facing the cap unit 61, absorbs ink in the inside of the nozzle of the recording head 44 using the pump 63, or receives ink which is discarded from the recording head 44 using a flushing operation.

The waste ink cartridge 57 is connected to the cap unit 61 through the pump 63. The waste ink cartridge 57 accommodates waste ink which is discarded from the cap unit 61, or waste ink which is suctioned using the pump 63, and is sent out from the pump 63 in the cartridge.

The control unit 54 is configured of a plurality of substrates. According to the embodiment, the control unit 54 includes a first substrate 58 and a second substrate 60 (refer to FIG. 5). As illustrated in FIGS. 5 and 6, the first substrate 58 and the second substrate 60 are arranged on the lower side of the medium support unit 24 in the medium support unit 24, and are arranged so as to be close to the battery accommodation unit 56. In addition, a plurality of electrical resistors, capacitors, and the like, are arranged, and an electrical circuit is formed in each substrate.

As illustrated in FIG. 5, the first substrate 58 is provided in an erect posture on the rear surface side of the apparatus main body 12, that is, along the Z axis direction at an end portion on the +Y axis direction side, and is fixed to a part of the frame 66 which forms the medium support unit 24 (refer to FIG. 6). In addition, the second substrate 60 is formed in a posture intersecting the first substrate 58 (refer to FIG. 5). Specifically, the second substrate 60 is provided at a base portion of the apparatus main body 12, and is provided in parallel to an XY plane which intersects the Z axis direction (refer to FIG. 8).

In addition, as illustrated in FIG. 4, a shield plate 62 is attached to the first substrate 58. In addition, a shield plate 64 is attached to the second substrate 60, as well. The shield plates 62 and 64 according to the embodiment are formed of a conductive material, and reduce an influence of noise with respect to the first substrate 58 and the second substrate 60.

As illustrated in FIG. 7, in the first substrate 58, a notch portion 58*a* as a "first notch portion" is formed at an end portion on the −X axis direction side. The battery accommodation unit 56 is arranged in a state in which a part thereof is put into the notch portion 58*a* of the first substrate 58 in the X axis direction, on the rear surface side of the apparatus main body 12.

In addition, at least a part of an arranging region of the battery accommodation unit 56 with respect to the apparatus main body 12 in the Z axis direction which is the apparatus height direction of the apparatus main body 12 is in the same range as those of the first substrate 58 and the second substrate 60. Accordingly, since it is not necessary to arrange the battery accommodation unit 56, and each of substrates 58 and 60 in a stacking manner in the apparatus height direction (Z axis direction), it is possible to make a dimension of the printer 10 in the apparatus height direction (Z axis direction) small, or to reduce the dimension.

In addition, as illustrated in FIG. 8, a notch portion 60*a* as a "first notch portion" is formed at an end portion on the −X axis direction side of the second substrate 60. The battery accommodation unit 56 is arranged in a state in which a part thereof is put into the notch portion 60*a* of the second substrate 60 in the X axis direction at the base portion of the apparatus main body 12.

In addition, as illustrated in FIG. 5, the second substrate 60 is provided at the base portion of the apparatus main body 12, and also the ink absorbing body 55 and the waste ink cartridge 57 are provided at the base portion of the apparatus main body 12. That is, an occupying region of the second substrate 60 in the apparatus height direction overlaps with occupying regions of the ink absorbing body 55 and the waste ink cartridge 57.

Accordingly, it is possible to miniaturize the apparatus in a configuration of including the ink absorbing body 55 and the waste ink cartridge 57.

In addition, at least a part of the arranging region of the battery accommodation unit 56 with respect to the apparatus main body 12 in the Y axis direction which is the apparatus depth direction in the apparatus main body 12 is in the same range as those of the first substrate 58 and the second substrate 60. Accordingly, since it is not necessary to arrange the battery accommodation unit 56, and each of substrates 58 and 60 in an overlapping manner in the apparatus depth direction (Y axis direction), it is possible to make a dimension of the printer 10 in the apparatus depth direction (Y axis direction) small, or to reduce the dimension.

In addition, in the battery accommodation unit 56according to the embodiment, at least a part thereof is put into the first notch portion 58*a* which is formed on the first substrate 58, and is put into a first notch portion 60*a* which is formed on the second substrate 60.

Accordingly, with such a configuration, it is possible to miniaturize the apparatus.

In addition, when referring to FIGS. 5 to 7, the notch portion 58*b* as a "second notch portion" is formed at the end portion on the +X axis direction side of the first substrate 58. In addition, when referring to FIGS. 5, 6, and 8, the notch portion 60*b* as a "second notch portion" is formed at the end portion on the +X axis direction side of the second substrate 60. According to the embodiment, the driving motor 38 which is illustrated in FIG. 5 is arranged at a position corresponding to the notch portion 58*b* of the first substrate 58 and the notch portion 60*b* of the second substrate 60 at the end portion on the +X axis direction side of the apparatus main body 12 (medium support unit 24).

That is, according to the embodiment, the driving motor 38 is put into the second notch portion 58*b* which is formed on the first substrate 58, and in put into the second notch portion 60*b* which is formed on the second substrate 60.

Accordingly, with such a configuration, it is possible to miniaturize the apparatus.

Here, a positional relationship between the battery accommodation unit 56, the first substrate 58 and the second substrate 60 will be summarized. A plurality of electronic components are attached to the first substrate 58 and the second substrate 60, and an electrical circuit is formed. Heat emitted from the electronic components is radiated from a substrate face onto which the electronic components are attached in the first substrate 58 and the second substrate 60, and is emitted to a region which faces the substrate face. Since the battery accommodation unit 56 is located to the side of the first substrate 58 in the X axis direction in FIG. 7, the battery accommodation unit does not face the substrate face of the first substrate 58. Accordingly, the battery accommodation unit 56 is arranged so as to hardly receive the heat radiated from the first substrate 58 directly, in the inside of the apparatus main body 12.

In addition, since the battery accommodation unit 56 is located to the side of the second substrate 60 in the X axis direction in FIG. 8, the battery accommodation unit does not face the substrate face of the second substrate 60. Accordingly, the battery accommodation unit 56 is arranged so as to hardly receive the heat radiated from the second substrate 60 directly, in the inside of the apparatus main body 12.

When summarizing the above descriptions, since the battery accommodation unit 56, the first substrate 58, and the second substrate 60 are arranged on the lower side of the medium support unit 24, and the battery accommodation unit 56 is arranged at a position separated from a place which faces the first substrate 58 and the second substrate 60, it is difficult for a battery 74 (refer to FIG. 13A) to directly receive heat radiated from the first substrate 58 and the second substrate 60, and it is possible to keep the battery 74 in a good state.

Regarding Configuration of Medium Support Unit and Battery Accommodation Unit

In addition, configurations of the medium support unit 24 and the battery accommodation unit 56 will be described with reference to FIGS. 9 to 13. As illustrated in FIG. 9, the medium support unit 24 includes the frame 66. The support member 30 is attached to the higher part of the frame 66. The support member 30 is configured so as to oscillate with respect to the frame 66 about a pair of oscillating shafts 68 which is provided at the higher end of the support member 30.

In addition, a feeding roller driving shaft 70 which extends in the X axis direction at a position facing the support member 30 is attached to the frame 66 so as to rotate with respect to the frame 66. The feeding roller 26 is attached to the feeding roller driving shaft 70 so as to rotate integrally with the feeding roller driving shaft 70.

In addition, in the frame 66, a plurality of openings 72 are provided on the downstream side of the support member 30 on the medium transport path with appropriate intervals in the X axis direction. A medium returning lever 28 is provided in each opening 72. The medium returning lever 28 is driven in an oscillating manner so as to proceed to, or retreat from the medium transport path using a driving mechanism (not illustrated) which receives a driving power from the feeding roller driving motor 32. In addition, when the medium returning lever 28 proceeds to the medium transport path, at least a part of the medium returning lever 28 protrudes to the medium transport path side from the opening 72, and is exposed from the opening 72.

As illustrated in FIGS. 10 to 12, the battery accommodation unit 56 is provided at the lower part of the frame 66. More specifically, as illustrated in FIG. 11, the frame 66 is formed downward toward the −Y direction side in an inclined shape, and the support member 30 is provided on the inclined face (refer to FIG. 3). In addition, the support member 30 is not illustrated in FIG. 11.

Since the medium support unit 24 supports a sheet in an inclined posture, a space (dead space) is formed on the lower side thereof. The battery accommodation unit 56 is arranged using the space. More specifically, the battery accommodation unit 56 is formed integrally with the frame 66 at a center portion of the frame 66 in the X axis direction in the space. That is, since the battery accommodation unit 56 is formed integrally with the frame 66 which forms the medium support unit 24, it is possible to reduce a cost of the printer 10.

The battery accommodation unit 56 is formed in a box shape as illustrated in FIGS. 10 to 12, and is open in the −Z axis direction. The battery 74 is detachably inserted into the battery accommodation unit 56. As illustrated in FIG. 10, a battery accommodation unit cover 76 is detachably attached to an opening of the battery accommodation unit 56 in the −Z axis direction.

The battery 74 is formed so as to extend in the X axis direction, as illustrated in FIG. 13A. In addition, terminals are respectively provided on both end portions of the battery 74 in the X axis direction, though the terminals are not illustrated in FIG. 13A. Both these terminals are electrically connected to each of substrates 58 and 60, the feeding roller driving motor 32, the driving motor 38, and the carriage driving motor 48 of the control unit 54, and supply power for driving these members.

In addition, the battery accommodation unit cover 76 is formed in a box shape, and is open on the +Z axis direction side, as illustrated in FIG. 13B. The battery accommodation unit cover 76 is attached to the battery accommodation unit 56 using a fastening member such as a screw, or the like, which is not illustrated. In addition, when attaching the battery accommodation unit cover 76 to the battery accommodation unit 56 by accommodating the battery 74 in the battery accommodation unit 56, an elastic member 78 (refer to FIG. 11) is attached between the battery 74 and the battery accommodation unit cover 76.

In the embodiment, the elastic member 78 is configured of a sponge material. The elastic member 78 biases the battery 74 in the +Z axis direction in the battery accommodation unit 56 using an elastic force thereof, and holds the battery at a predetermined position in the battery accommodation unit 56, when the battery 74 is accommodated in the battery accommodation unit 56, and the battery accommodation unit cover 76 is attached to the battery accommodation unit 56.

In addition, a plurality of engaging units 76*a* which protrude to the +Z axis direction side are provided at an end portion on the +Y axis direction side of the battery accommodation unit cover 76. When the battery accommodation unit cover 76 is attached to the battery accommodation unit 56, the engaging units 76*a* engage with a plurality of hooks 56*a* which are provided at the end portion on the Y axis direction side of the battery accommodation unit 56, respectively.

In addition, as illustrated in FIG. 11, when the battery accommodation unit cover 76 is attached to the battery accommodation unit 56, an elastic member 80 is arranged between the engaging unit 76*a* and the end portion on the +Y axis direction side of the battery accommodation unit 56. The elastic member 80 is also configured of a sponge material. The elastic member 80 prevents the battery accommodation unit cover 76 from deviating from the battery accommodation unit 56 in the Y axis direction in FIG. 11.

Regarding a Relationship Between Medium Support Unit and Second Substrate

Subsequently, a relationship between the frame 66 and the second substrate 60 in the medium support unit 24 will be described with reference to FIGS. 6, 9, 12, and 14. As described above, the plurality of openings 72 (refer to FIG. 9) which accommodate the medium returning levers 28 are provided in the frame 66. A space 82 (refer to FIG. 14) is formed on the −Z axis direction side of the opening 72 in the frame 66. The space 82 accommodates at least a part of the medium returning lever 28, as illustrated in FIG. 14.

In addition, as illustrated in FIG. 14, the second substrate 60 is arranged on the lower part of the frame 66. The second substrate 60 extends along the XY plane on the lower part of the frame 66. In addition, at least a part of the second substrate 60 faces the space 82.

Here, a heat radiating member 84 is provided between the second substrate 60 and an end portion on the −Z axis direction side of the space 82. That is, the heat radiating member 84 is provided at a position facing the opening 72 with respect to the second substrate 60. The heat radiating member 84 is configured of a material with high heat conductivity, as an example.

Here, a plurality of electrical resistors, capacitors, or the like, are provided in the second substrate 60, and when the control unit 54 is electrically connected, these members radiate heat. Heat which is radiated from the second substrate 60 is transmitted to the space 82 through the heat radiating member 84, and is emitted from the space 82 through the opening 72.

That is, according to the embodiment, since the opening 72 which is formed in the frame 66 which forms the medium support unit 24, and exposes the medium returning lever 28 also functions as a heat radiating port which emits heat generated from the second substrate 60, it is not necessary to provide a separate heat radiating port which emits heat generated from the second substrate 60, it is possible to reduce a cost of the apparatus, and to emit heat which is generated from the second substrate 60 well.

In addition, according to the embodiment, since the heat radiating member 84 partitions the space 82 from the second substrate 60, it is possible to prevent dust, or the like, which enters the space 82 from the opening 72 from being attached to the second substrate 60. As a result, it is possible to maintain a performance of the second substrate 60 well.

Modification Example of Embodiment (1) According to the embodiment, it is a configuration in which heat in the second substrate 60 is radiated from the opening 72; however, it may be a configuration in which heat is radiated from the first substrate 58 through the opening 72 instead of this configuration, or it may be a configuration in which heat of both the first substrate 58 and the second substrate 60 is radiated from the opening 72.

In addition, it may be a configuration in which a flap member is attached to the medium returning lever 28, air in the space 82 is agitated when the medium returning lever 28 is operated, and heat radiation from the opening 72 is promoted.

(2) According to the embodiment, it is a configuration in which the driving motor 38 is arranged at positions corresponding to the notch portion 58*b* of the first substrate 58, and the notch portion 60*b* of the second substrate 60; however, it may be a configuration in which the feeding roller driving motor 32 is arranged at positions corresponding to the notch portion 58*b* of the first substrate 58, and the notch portion 60*b* of the second substrate 60, instead of the configuration.

When summarizing the above description, the printer 10 according to the embodiment includes the medium support unit 24 which supports a medium in an inclined state, the feeding roller 26 which sends out the medium which is supported by the medium support unit 24, the substrates 58 and 60 which configure the control unit 54 of the apparatus, and the battery accommodation unit 56 which accommodates the battery 74 which is a power source of the feeding roller 26 and the control unit 54.

The battery accommodation unit 56, and the substrates 58 and 60 are arranged on the lower side of the medium support unit 24, and the battery accommodation unit 56 is arranged at a position separated from a place which faces the substrates 58 and 60. At least a part of the arranging region of the battery accommodation unit 56, and at least part of the arranging regions of the substrates 58 and 60 are in the same range in the height direction.

In addition, at least a part of the arranging region of the battery accommodation unit 56, and at least part of the arranging regions of the substrates 58 and 60 are in the same range in the apparatus depth direction.

At least a part of the battery accommodation unit 56 is put into the notch portions 58*a* and 60*a* which are formed in the substrates 58 and 60. In addition, the battery accommodation unit 56 is provided at a center portion in the medium width direction intersecting the Y axis direction which is the medium feeding direction, that is, in the X axis direction. The battery accommodation unit 56 is provided on the rear side in the Y axis direction which is the apparatus depth direction, that is, on the +Y axis direction side in the space which is formed on the lower side of the medium support unit 24.

The printer 10 includes the plurality of substrates 58 and 60. The first substrate 58 which configures the plurality of substrates is provided in an erect posture on the rear surface side in the apparatus depth direction, that is, on the +Y axis direction side, and the second substrate 60 which configures the plurality of substrates is formed in a posture intersecting the first substrate 58.

The printer 10 includes the feeding roller driving motor 32 and the driving motor 38 which are driven by the battery 74. The feeding roller driving motor 32 and the driving motor 38 are provided on both sides of the battery accommodation unit 56 in the medium width direction which is a direction intersecting the Y axis direction which is the medium feeding direction, that is, in the X axis direction.

At least one of the feeding roller driving motor 32 and the driving motor 38 is put into the second notch portion 58*b* which is formed in the first substrate 58, and is put into the second notch portion 60*b* which is formed in the second substrate 60.

The printer 10 includes the medium returning lever 28 which returns a tip end of a medium which is sent out from the medium support unit 24 to the medium support unit 24 side, and the opening 72 which is formed in the frame 66 which forms the medium support unit 24, and exposes the medium returning lever 28. The opening 72 also functions as the heat radiating port which emits heat generated from the second substrate 60.

The battery accommodation unit 56 is formed integrally with the frame 66 which forms the medium support unit 24. Heat generated from the second substrate 60 is emitted from the opening 72 through the heat radiating member 84 which is provided at a position facing the opening 72 with respect to the second substrate 60.

The printer 10 includes the recording head 44 which ejects liquid with respect to a medium, the platen 46 which is provided at a position which can face the recording head 44, and supports the medium, the ink absorbing body 55 which holds ink which is ejected to a region separated from an end portion of a medium, and is guided from the higher part to the lower part of the platen 46, and the waste ink cartridge 57 which holds ink ejected as waste ink from the recording head 44. The occupying region of the second substrate 60 overlaps the occupying region of the ink absorbing body 55, and the occupying region of the waste ink cartridge 57 in the apparatus height direction.

In addition, according to the embodiment of the invention, the battery accommodation unit 56 is applied to an ink jet printer as an example of the recording apparatus; however, it is also possible to apply the battery accommodation unit to a general liquid ejecting apparatus other than that.

Here, the liquid ejecting apparatus is not limited to a printer in which an ink jet recording head is used, and recording is performed on a medium for recording by ejecting ink from the recording head, and a recording apparatus such as a copy machine, a fax machine, or the like, and includes an apparatus in which liquid corresponding to a use thereof, instead of ink, is ejected onto a medium for ejecting corresponding to the medium for recording from a liquid ejecting head corresponding to the ink jet recording head, and the liquid is attached to the medium for ejecting.

As the liquid ejecting head, there are a coloring material ejecting head which is used when manufacturing a color filter such as a liquid crystal display, an electrode material (conductive paste) ejecting head which is used when forming an electrode of an organic EL display, a surface emission display (FED), or the like, a bioorganic substance ejecting head which is used when manufacturing a biochip, a sample ejecting head as a precision pipette, and the like, in addition to the recording head.

In addition, the invention is not limited to the above-described embodiment, and can be variously modified in the scope of the invention which is described in claims, it being needless to say that such modification examples are also included in the scope of the invention.

The entire disclosure of Japanese Patent Application No. 2014-062090, filed Mar. 25, 2014 is expressly incorporated by reference herein.

What is claimed is:

1. A recording apparatus comprising:

a housing which has a bottom surface, a front surface and a rear surface;

a medium supply unit which sends out a medium, and is arranged in the rear surface side of the housing;

a recording unit which performs recording on the medium sent from the medium supply unit;

a discharging unit which discharges the medium recorded by the recording unit, and is arranged in the front surface side of the housing;

a first substrate which configures a control unit of the apparatus, and is arranged along the rear surface of the housing; and a battery accommodation unit which accommodates a battery which is a power source of the medium supply unit and the control unit, and is arranged in a corner portion constituted between the bottom surface and the rear surface of the housing, wherein the battery accommodation unit is adjacent to the first substrate, and wherein the battery accommodation unit and the first substrate overlaps each other in a direction perpendicular to the bottom surface of the housing.

2. The recording apparatus according to claim 1, wherein the first substrate has a first notch portion, and wherein the battery accommodation unit is adjacent to the first notch portion of the first substrate.

3. The recording apparatus according to claim 1, wherein the battery accommodation unit is provided at a center portion in a medium width direction which is a direction intersecting a medium feeding direction.

4. The recording apparatus according to claim 3, further comprising:

a first motor and a second motor which are driven by the battery, wherein the first motor and the second motor are provided on both sides of the battery accommodation unit in the medium width direction which is the direction intersecting the medium feeding direction.

5. The recording apparatus according to claim 4, wherein the first substrate has a first notch portion, wherein at least one of the first motor and the second motor is adjacent to the first notch of the first substrate.

6. The recording apparatus according to claim 1, wherein the medium supply unit comprises a medium support unit which supports the medium in an inclined state and a feeding roller which sends the medium supported by the medium support, wherein the battery accommodation unit is arranged in a space which is formed on a lower side in a state in which the medium support unit is inclined, and wherein the feeding roller is driven by the battery.

7. The recording apparatus according to claim 6, wherein the battery accommodation unit is formed integrally with the frame which forms the medium support unit.

8. The recording apparatus according to claim 1, further comprising:

a second substrate which configures the control unit of the apparatus, and is arranged along the bottom of the housing, wherein the battery accommodation unit is adjacent to the second substrate.

9. A recording apparatus comprising:

a housing which has a bottom surface, a front surface and a rear surface;

a medium supply unit which sends out a medium, and is arranged in the rear surface side of the housing;

a recording unit which performs recording on the medium sent from the medium supply unit;

a discharging unit which discharges the medium recorded by the recording unit, and is arranged in the front surface side of the housing;

a first substrate which configures a control unit of the apparatus, and is arranged along the rear surface of the housing;

a second substrate which configures the control unit of the apparatus, and is arranged along the bottom surface of the housing; and a battery accommodation unit which accommodates a battery which is a power source of the control unit, and is arranged in a corner portion constituted between the bottom surface and the rear surface of the housing, wherein the first substrate has a first notch portion, wherein the second substrate has a first notch portion, and wherein the battery accommodation unit is adjacent to both the first notch portion of the first substrate and the first notch portion of the second substrate.

10. A recording apparatus comprising:

a housing which has a bottom surface, a front surface and a rear surface;

a medium supply unit which sends out a medium, and is arranged in the rear surface side of the housing;

a recording unit which performs recording on the medium sent from the medium supply unit;

a discharging unit which discharges the medium recorded by the recording unit, and is arranged in the front surface side of the housing;

a second substrate which configures a control unit of the apparatus, and is arranged along the bottom surface of the housing; and a battery accommodation unit which accommodates a battery which is a power source of the medium supply unit and the control unit, and is arranged in a corner portion constituted between the bottom surface and the rear surface of the housing, wherein the battery accommodation unit is adjacent to the second substrate, and wherein the battery accommodation unit and the second substrate overlaps each other in a direction from the rear surface to the front surface of the housing.

11. The recording apparatus according to claim 10, wherein the medium supply unit comprises a medium support unit which supports the medium in an inclined state and a feeding roller which sends the medium supported by the medium support, wherein the battery accommodation unit is arranged in a space which is formed on a lower side in a state in which the medium support unit is inclined, and wherein the feeding roller is driven by the battery.

12. The recording apparatus according to claim 11, wherein the medium supply unit further comprises a medium returning member which returns a tip end of a medium which is sent out from the medium support unit to the medium support unit side, a frame which forms the medium support unit and an opening which is formed on the frame, and exposes the medium returning member, wherein the opening also functions as a heat radiating port from which heat generated from the second substrate is emitted.

13. The recording apparatus according to claim 12, wherein heat generated from the second substrate is emitted from the opening through a heat radiating member which is provided at a location facing the opening with respect to the second substrate.

14. The recording apparatus according to claim 10, further comprising:

a support member which is provided at a location in which it is possible to face the recording unit; and a liquid holding unit which holds liquid ejected as waste liquid from the recording unit, wherein the liquid holding unit is arranged along the bottom where positioned at the discharging unit side than the second substrate.

* * * * *